US005490700A

United States Patent [19]

Zuckerman

[11] Patent Number: 5,490,700

[45] Date of Patent: Feb. 13, 1996

[54] SHEET METAL U.L. SCREW

[75] Inventor: Martin Zuckerman, Villa Park, Calif.

[73] Assignee: Emhart Inc., Newark, Del.

[21] Appl. No.: 283,462

[22] Filed: Aug. 3, 1994

[51] Int. Cl.[6] ..... E05B 3/00

[52] U.S. Cl. ..... 292/357; 292/350

[58] Field of Search ..... 292/347, 350, 292/351, 356, 357

[56] References Cited

U.S. PATENT DOCUMENTS

| | | | |
|---|---|---|---|
| 3,713,683 | 1/1973 | Neary | 292/351 X |
| 4,869,083 | 8/1989 | Demarseilles et al. | 292/357 X |
| 5,118,152 | 6/1992 | Lin | 292/357 X |
| 5,125,696 | 6/1992 | Robida et al. | 292/169.16 |
| 5,149,155 | 9/1992 | Caeti et al. | 292/357 X |
| 5,236,235 | 8/1993 | Gustafson et al. | 292/357 |
| 5,263,510 | 11/1993 | Heimann et al. | 292/357 X |
| 5,265,924 | 11/1993 | Kim | 292/357 X |
| 5,296,162 | 12/1993 | Robida et al. | 70/224 |
| 5,335,950 | 8/1994 | Mirshafiee et al. | 292/356 |

*Primary Examiner*—Peter M. Cuomo
*Assistant Examiner*—Monica E. Millner

[57] ABSTRACT

A tubular lock assembly which is to be located within a suitable thru bore in a door comprising: a pair of rose liner assemblies each including a rose liner, a collar selectively sized to effectively close the thru bore of the door, and means for securing the collar on the rose liner. Means for securing the rose liner assemblies together on either side of the door with the collars effectively closing the door thru bore, the securing means including a screw interconnecting the collars.

4 Claims, 2 Drawing Sheets

SHEET METAL U.L. SCREW

The present invention relates to tubular lock assemblies.

U.S. Pat. Nos. 5,125,696 and 5,269,162 disclose state of the art tubular lock assemblies which include interior and exterior operator assemblies each of which includes a rose liner which due to its surface complexity is conventionally made of zinc or some other non-steel material. In use, the two rose liners will be connected to close the opening in the door which receives the lock. In a fire, the zinc rose liners may be consumed and the door opening may become open.

It is accordingly an object of the present invention to provide such a lock which will permanently close this door opening.

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings.

Figure 1:
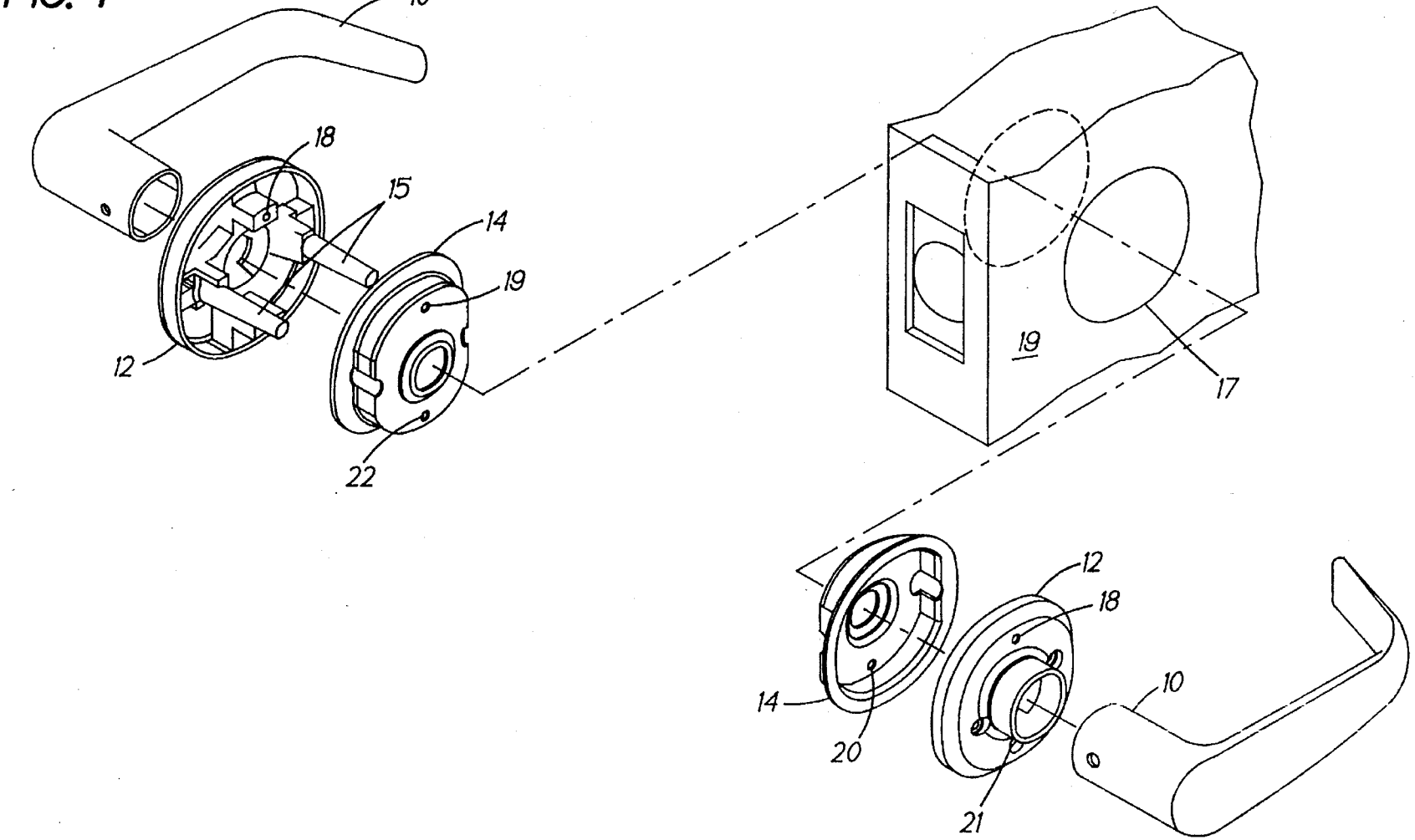
FIG. 1 is an oblique view of a number of parts of a tubular lock assembly shown separated for clarity.
Figure 2:
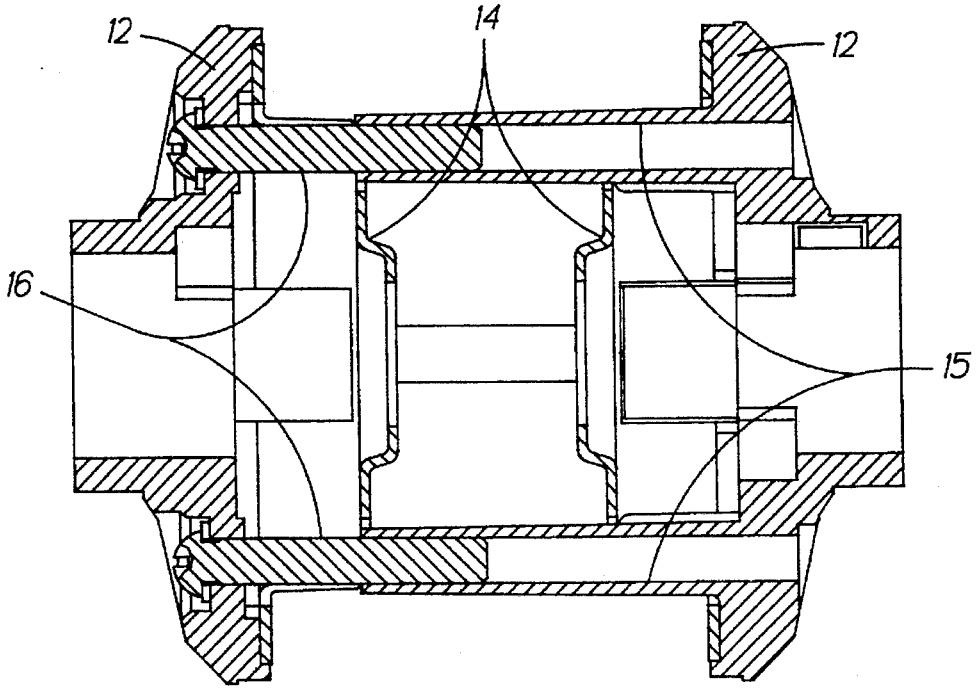
FIG. 2 is a cross-sectional view taken horizontally through the interconnected rose liners and collars shown in FIG. 1 through the connecting posts.

Conventional tubular lock assemblies are operated by rotating interior and exterior knobs or levers 10 which are connected to sleeve assemblies (not shown) that operate a latch (also, not shown) having a retractable bolt. As can be seen from FIG. 1, the rose liners 12 have considerable detail and as a result, are conventionally made from zinc. The collars 14 are relatively simple and are made of steel. One of the rose liners has a pair of posts 15 so that the opposed rose liners can be secured together by suitable screws 16 (FIG. 2). In a fire, the zinc rose liners and many of the parts making up the sleeve assemblies (some of which are contained between a rose liner and its collar), may be consumed by the heat and as a result, the opening 17 in the door 19 which receives the tubular lock assembly may be substantially opened.

Figure 3:
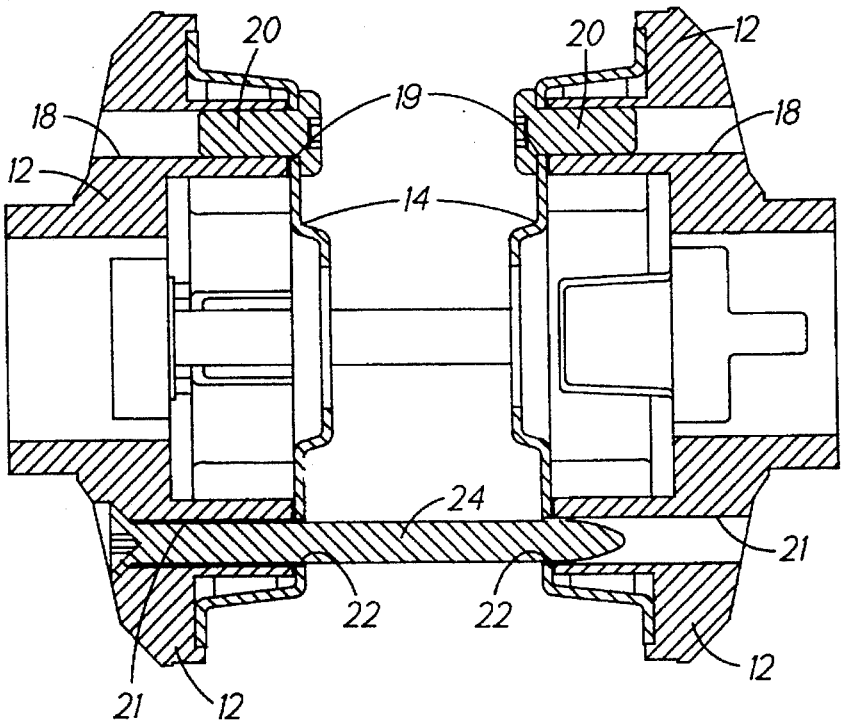
FIG. 3 is a cross-sectional view taken vertically, centrally through the interconnected rose liners and collars shown in FIG. 1.

A horizontal hole 18 is defined in each of the rose liners 12 which communicate with a hole 19 in the associated steel collar 12. Screws 20 (FIG. 3) are inserted through each of these holes to secure the collars to the rose liners. A larger horizontally extending hole 21 is defined in each of the rose liners to communicate with corresponding holes 22 in the collars. A sheet metal (self tapping) U.L. screw 24, taps its way through the lowermost aligned rose liner 21 and collar holes 22 to secure these parts together and to establish connections with the collars that will not be effected by vibrations or the like. A rose liner/collar is located on either face of a door and is secured in place by the post screws 16. In the event of fire, the zinc rose liners may be consumed but sheet metal screw 24 will keep the steel collars 14 in place keeping the door opening substantially closed.

I claim:

1. A tubular lock assembly which is to be located within a suitable thru bore in a door comprising:

a pair of rose liner assemblies each including a rose liner a steel collar selectively sized to effectively close the thru bore of the door, and means for securing said collar on said rose liner, fastener means for securing said rose liner assemblies together on either side of the door with said collars effectively closing the door thru bore, coaxial holes in one of said rose liners and in each of said steel collars and a self tapping screw extending through said hole in said one rose liner and through said holes in said steel collars, said steel collar holes being selectively sized so that said self tapping screw will define a screw thread therein during insertion to permanently maintain said steel collars closing the door thru bore.

2. A tubular lock assembly according to claim 1, wherein said tapping screw is a sheet metal screw.

3. A tubular lock assembly according to claim 2, wherein said rose liners are made of zinc.

4. A tubular lock assembly according to claim 1, wherein said second rose liner has a hole coaxial with said holes in said collars and coaxial with said hole in said one rose, said self tapping screw located in said second rose hole.

* * * * *